US008735726B2

(12) United States Patent
Skocypec

(10) Patent No.: US 8,735,726 B2
(45) Date of Patent: May 27, 2014

(54) JACKET FOR DATA CABLE

(75) Inventor: Brian P. Skocypec, North Attleboro, MA (US)

(73) Assignee: General Cable Technologies Corporation, Highland Heights, KY (US)

( * ) Notice: Subject to any disclaimer, the term of this patent is extended or adjusted under 35 U.S.C. 154(b) by 386 days.

(21) Appl. No.: 12/625,747

(22) Filed: Nov. 25, 2009

(65) Prior Publication Data

US 2010/0175910 A1 Jul. 15, 2010

Related U.S. Application Data

(60) Provisional application No. 61/144,661, filed on Jan. 14, 2009.

(51) Int. Cl.
*H01B 7/00* (2006.01)

(52) U.S. Cl.
USPC ..... 174/110 R; 174/113 R

(58) Field of Classification Search
USPC ..... 174/113 R, 110 R
See application file for complete search history.

(56) References Cited

U.S. PATENT DOCUMENTS

| | | | | |
|---|---|---|---|---|
| 5,042,904 | A | 8/1991 | Story et al. | |
| 5,777,260 | A | 7/1998 | Klumps et al. | |
| 5,990,419 | A * | 11/1999 | Bogese, II | 174/120 R |
| 6,545,222 | B2 * | 4/2003 | Yokokawa et al. | 174/110 R |
| 7,145,080 | B1 | 12/2006 | Boisvert et al. | |
| 7,256,351 | B2 | 8/2007 | Dillon et al. | |
| 7,271,344 | B1 | 9/2007 | Stutzman et al. | |
| 7,993,568 | B2 | 8/2011 | Heffner | |
| 2007/0098940 | A1 * | 5/2007 | Heffner | 428/36.9 |
| 2007/0235208 | A1 | 10/2007 | Jean | |
| 2008/0115959 | A1 | 5/2008 | Stutzman et al. | |

FOREIGN PATENT DOCUMENTS

| | | |
|---|---|---|
| EP | 1783787 | 5/2008 |

* cited by examiner

*Primary Examiner* — Chau N Nguyen
(74) *Attorney, Agent, or Firm* — Blank Rome LLP

(57) ABSTRACT

A jacket for a data cable that comprises a main jacket body having an inner area for receiving one or more filaments and a central longitudinal axis. The main body has an inner surface that surrounds the inner area and an opposite outer surface. At least one longitudinal opening extends through the main jacket body between the inner and outer surfaces and substantially parallel to the central longitudinal axis of the main jacket body. The longitudinal opening is substantially enclosed within the main jacket body.

21 Claims, 2 Drawing Sheets

JACKET FOR DATA CABLE

RELATED APPLICATION

The present application claims priority under 35 U.S.C. §119(e) to U.S. Provisional Patent Application No. 61/144,661, filed Jan. 14, 2009, the entire disclosure of which is incorporated herein by reference.

FIELD OF THE INVENTION

The present invention relates to a jacket, preferably an unshielded jacket, for a data or telecommunications cable. More specifically, the present invention relates to a jacket for data cable with improved dielectric properties.

BACKGROUND OF THE INVENTION

Data cable is a collection of filaments laid together so that the assembly can be handled conveniently. In the present context, the filaments may be wires, insulated wires, pairs, coaxial tubes, optical fibers, etc. The data cable preferably has sufficient strength and flexibility for its purpose. A common way to achieve this is to twist the filaments together to form a collection of helices. That not only forms a compact cable in cross-section, but also gives flexibility, so that when the cable is bent, the portion on the outside of the bend draws the necessary extra length of filaments from the inside of the bend. That suggests that the cable should not be so compacted that the filaments cannot move relative to each other. On the other hand, too loose a cable will easily deform or flatten when bent or compressed.

Unshielded twisted pair (UTP) cabling is the most common cable used in computer networking. It is a variant of twisted pair cabling. UTP cables are often called "Ethernet cables", the most common data networking standard that utilizes UTP cables, although not the most reliable. In contrast to FTP (foil twisted pair) and STP (shielded twisted pair) cabling, UTP cable is not surrounded by any shielding. UTP is the primary wire type for telephone usage and is very common for computer networking, especially in patch cables or temporary network connections due to the high flexibility of the cables.

STP cable comprises a number of shielded twisted pairs within an overall screen and sheath. The benefits of STP cabling versus UTP cabling is a debate gaining momentum as data transmission speed increases. If, for example, CAT 7 cable using UTP is incorrectly installed, its performance could be worse than CAT 5 cable. And with STP, ground loops, current flowing along a shield between grounds at different potentials, can inject noise into the wires that the shields are intended to protect.

One factor contributing to lack of progress in the adoption of CAT 7 is the confusion caused by the manufacturer-specific nature of actual CAT 6 installations. In practice, CAT 6 cables, connectors, patch panels, and related products cannot be mixed with those from another manufacturer without degrading system performance. One effect of the subtle differences among components is to cause impedance mismatches that generate reflections and affect return loss.

Alien crosstalk (AXT) is electromagnetic noise that can occur in a cable that runs alongside one or more other signal-carrying cables. The term "alien" arises from the fact that this form of crosstalk occurs between different cables in a group or bundle, rather than between individual wires or circuits within a single cable. Alien crosstalk can be particularly troublesome because, unlike the simple crosstalk caused by a single interfering signal, it cannot be eliminated by phase cancellation. Alien crosstalk arises from multiple signals, and includes mixing products in which phantom signals at innumerable sum and difference frequencies blend with the originating signals. The result is a "hash" of electromagnetic noise that is too complex to be dealt with by phase-cancellation measures. Because it resembles noise rather than signals, alien crosstalk degrades the performance of a communications system by reducing the signal-to-noise ratio (S/N).

Alien crosstalk can be minimized or eliminated by avoiding configurations in which cables are bundled together or run parallel to one another in close proximity. If cables must be run parallel to each other, each cable can be surrounded by a grounded metal braid (STP or electromagnetic shield) to prevent electromagnetic fields from entering or leaving the cable. This in effect isolates the cables from one another. However, it is an expensive solution and it can also increase cable loss per unit length.

SUMMARY OF THE INVENTION

Accordingly, the present invention relates to a jacket for a data cable that comprises a main jacket body having an inner area for receiving one or more filaments and a central longitudinal axis. The main body has an inner surface that surrounds the inner area and an opposite outer surface. At least one longitudinal opening extends through the main jacket body between the inner and outer surfaces and is substantially parallel to the central longitudinal axis of the main jacket body. The longitudinal opening is substantially enclosed within the main jacket body.

The present invention also relates to a data cable that comprises a jacket including a main jacket body that has an inner area and a central longitudinal axis. The main body is a single layer with an inner surface that surrounds the inner area and an opposite outer surface. At least one longitudinal opening extends through the main jacket body between the inner and outer surfaces and is substantially parallel to the central longitudinal axis of the main jacket body. The at least one longitudinal opening is substantially enclosed in the main jacket body. A plurality of filaments are received in the inner area of the jacket.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
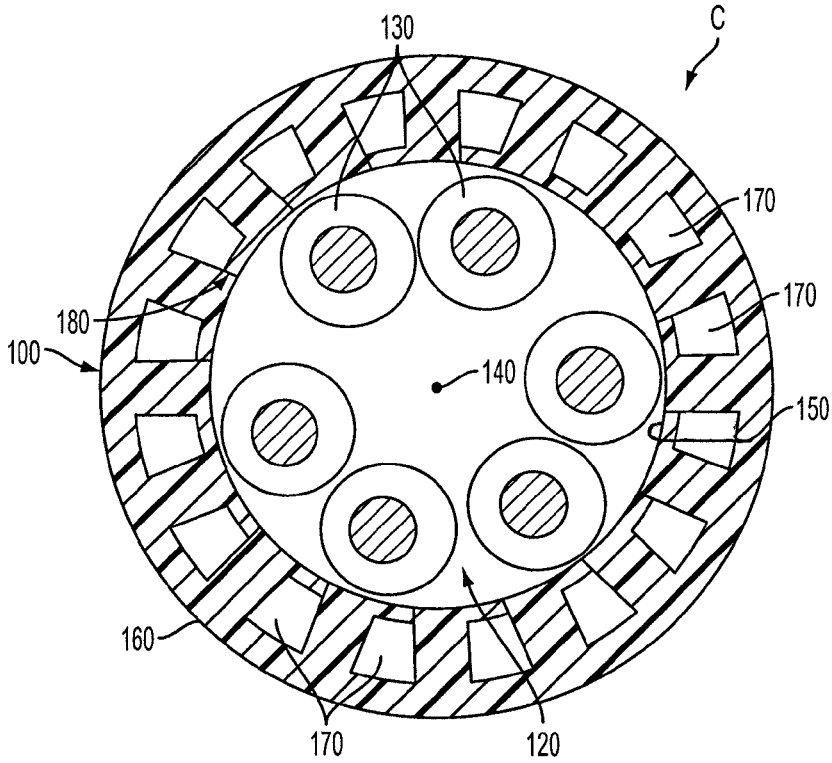
FIG. 1 is a cross-sectional view of a jacket for a data cable according to one embodiment of the invention showing the jacket supporting a plurality of filaments.
Figure 2:
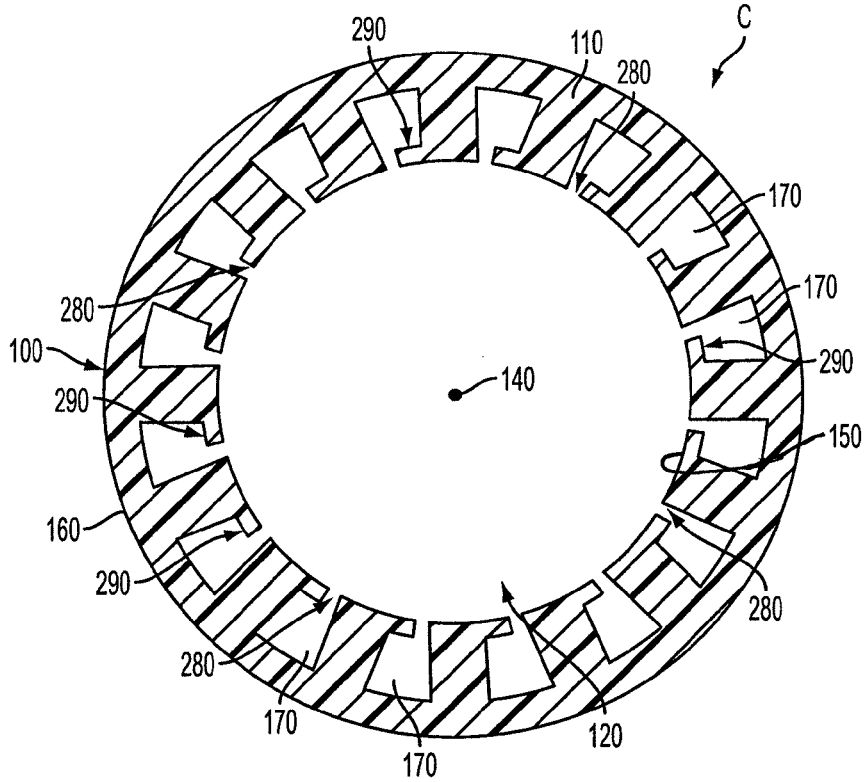
FIG. 2 is a cross-sectional view of the jacket illustrated in FIG. 1, showing the jacket without the plurality of filaments.

Referring to FIGS. 1 and 2, a jacket 100 for data cable C according to an embodiment of the invention provides increased dielectric properties required for high speed data cabling, such as CAT 7, while using less material than conventional jackets. Also, the jacket 100 is preferably unshielded and therefore avoids the potential problems of using a shielded cable for CAT 7, for example.

Jacket 100 may include a main jacket body 110 that has a generally tubular shape and defines an inner area 120 for receiving one or more filaments 130. The filaments 130 may be individual conductive wires, insulated wire pairs, coaxial tubes, optical fibers and the like. FIG. 1 illustrates the filaments 130 as twisted wire pairs, for example, forming the core of the cable C. The filaments 130 preferably extend generally parallel to the central longitudinal axis 140 of the jacket 100.

The main jacket body 110 is preferably one layer, but may be multiple layers, and has an inner surface 150 and an outer surface 160 opposite the inner surface 150. The inner surface is preferably continuous and surrounds the inner area 120. The filaments 130, such as the core of twisted wire pairs, preferably contact the inner surface 150 to maintain the shape of the cable C. The filaments 130, however, may be spaced or offset from the inner surface 150.

As seen in FIG. 1, a plurality of openings or holes 170 may extend through the main jacket body 110 between the inner and outer surfaces 150 and 160. The openings 170 add air to the jacket 100. Because air has the best dielectric constant, the overall dielectric constant of the jacket 100 is increased and suitable for applications, such as CAT 7 and the like. The openings 170 are preferably the same size, equally spaced and concentrically arranged with respect to the central longitudinal axis 140 of the jacket 100. The individual openings 170, however, can have different sizes and shapes with respect to one another. And although a plurality of openings 170 is preferred, only a single hole or opening may be employed.

The openings 170 preferably have a substantially trapezoidal shape. The openings 170 can have any shape, such as circular, polygonal, square, rectangular, diamond and the like. Each opening may include a gap or slot 280 (FIG. 2) extending through the inner surface 150. The slots 280 define a flap portion 290 (FIG. 2) of each opening 170. Because the slots 280 are substantially smaller than the openings 170, the slots 280 tend to close at the flap portions 290 when the filaments 130 are received in the inner area 120 of the jacket 200, as best seen in FIG. 1. That is because the filaments 130 may press on the inner surface 150 causing the slots 280 to close. Even when open at slots 280, however, the openings 170 are substantially enclosed. The flap portions 290 prevent the pairs from settling into the openings 170 without completely enclosing the openings 170. That results in a significant materials savings. By preventing the pair from moving into the opening (via the flap portion) cable-to-cable pair separation is maintained, thereby avoid degradation in alien crosstalk performance. The flap portions 290 also provide some additional support and minimize jacket crushing when the cable is on a reel.

Figure 3:
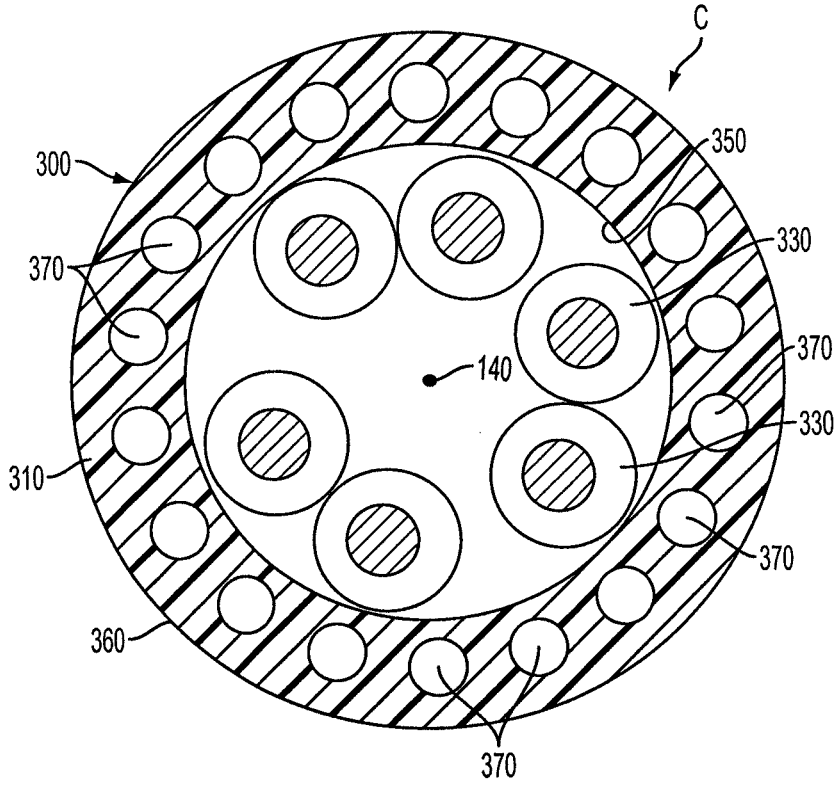
FIG. 3 is a cross-sectional view of a jacket for a data cable according to another embodiment of the invention.

FIG. 3 illustrates another embodiment of the invention, jacket 300, which supports filaments 330. Jacket 300 is similar to jacket 100 of the first embodiment; except that the plurality of holes 370, which extend through the jacket's main body 310 between its inner and outer surfaces 350 and 360, are substantially circular in cross-sectional shape and are preferably completely enclosed. Like the first embodiment, the holes 370 can be any size or shape, but are preferably the same size and shape, and are arranged concentrically around the central longitudinal axis 340 of the jacket 300.

While particular embodiments have been chosen to illustrate the invention, it will be understood by those skilled in the art that various changes and modifications can be made therein without departing from the scope of the invention as defined in the appended claims.

What is claimed is:

1. A jacket for a data cable, comprising:

a main jacket body having an inner area for receiving one or more filaments and a central longitudinal axis, said main jacket body having an inner surface surrounding said inner area and an opposite outer surface; and at least one longitudinal opening extending through said main jacket body between said inner and outer surfaces and substantially parallel to said central longitudinal axis of said main jacket body, said longitudinal opening having a flap portion, said flap portion being defined by a slot in said inner surface of said main jacket body, said slot being substantially smaller than said longitudinal opening, wherein said flap closes said slot and said longitudinal opening when the one or more filaments are received in said inner area of said main jacket body.

2. A jacket according to claim 1, wherein said at least one longitudinal opening comprises a plurality of longitudinal openings extending through said main jacket body between said inner and outer surfaces.

3. A jacket according to claim 2, wherein said openings are concentrically arranged with respect to said central longitudinal axis of said main jacket body.

4. A jacket according to claim 2, wherein said openings have substantially the same shape.

5. A jacket according to claim 2, wherein said openings have different shapes.

6. A jacket according to claim 1, wherein said at least one longitudinal opening has a substantially trapezoidal shape in cross-section.

7. A jacket according to claim 1, wherein said at least one longitudinal opening has a substantially circular shape in cross-section.

8. A jacket according to claim 1, wherein said flap portion substantially encloses said longitudinal opening.

9. A jacket according to claim 1, wherein said main jacket body is formed of PVC.

10. A jacket according to claim 1, wherein said main jacket body is formed of only a single layer.

11. A jacket according to claim 1, wherein said main jacket body is unshielded.

12. A jacket for a data cable, comprising:

a main jacket body having an inner area for receiving one or more filaments and a central longitudinal axis, said main jacket body having an inner surface surrounding said inner area and an opposite outer surface; and at least one longitudinal opening extending through said main jacket body between said inner and outer surfaces and substantially parallel to said central longitudinal axis of said main jacket body, said at least one longitudinal opening having a flap portion that substantially encloses said at least one longitudinal opening, said flap portion being defined by a slot in said inner surface of said main jacket body, said slot being substantially smaller than said longitudinal opening, wherein said flap closes said slot and said longitudinal opening when the one or more filaments are received in said inner area of said main jacket body.

13. A jacket according to claim 12, wherein said at least one longitudinal opening is substantially trapezoidal in cross-sectional shape.

14. A cable, comprising:

a jacket including, a main jacket body having an inner area and a central longitudinal axis, said main body being a single layer with an inner surface surrounding said inner area and an opposite outer surface; and at least one longitudinal opening extending through said main jacket body between said inner and outer surfaces and substantially parallel to said central longitudinal axis of said main jacket body, said at least one longitudinal opening having a flap portion that substantially encloses said at least one longitudinal opening, said flap portion being defined by a slot in said inner surface of said main jacket body, said slot being substantially smaller than said longitudinal opening; and a plurality of filaments received in said inner area of said jacket, wherein said flap closes said slot and said longitudinal opening when said plurality of filaments are received in said inner area of said main jacket body.

15. A cable according to claim 14, wherein said at least one longitudinal opening comprises a plurality of longitudinal openings extending through said main jacket portion between said inner and outer surfaces.

16. A cable according to claim 15, wherein said openings are concentrically disposed with respect to said central longitudinal axis.

17. A cable according to claim 14, wherein said filaments are one of wires, twisted insulated wire pairs, coaxial tubes, or optical fibers.

18. A cable according to claim 14, wherein said filaments contact said inner surface of said main jacket body.

19. A cable according to claim 14, wherein said main jacket body is unshielded.

20. A cable according to claim 14, wherein said at least one longitudinal opening has a substantially trapezoidal shape in cross-section.

21. A cable according to claim 14, wherein said at least one longitudinal opening has a substantially circular shape in cross-section.

* * * * *